United States Patent [19]

Wilson

[11] 4,411,088

[45] Oct. 25, 1983

[54] WATER RESISTANT CHARGE CONTAINER FOR FIREARMS

[76] Inventor: Hugh R. Wilson, 10840 SW. 120th St., Miami, Fla. 33176

[21] Appl. No.: 332,606

[22] Filed: Dec. 21, 1981

[51] Int. Cl.[3] ..... F42B 39/04; F41C 27/00

[52] U.S. Cl. ..... 42/90

[58] Field of Search ..... 42/90

[56] References Cited

U.S. PATENT DOCUMENTS

| | | | |
|---|---|---|---|
| 4,112,606 | 9/1978 | Griffin | 42/90 |
| 4,123,868 | 11/1978 | Wilson | 42/90 |
| 4,135,322 | 1/1979 | Tice et al. | 42/90 |
| 4,205,475 | 6/1980 | Wilson | 42/90 |
| 4,207,698 | 6/1980 | Burson | 42/90 |

OTHER PUBLICATIONS

"Load-N-Cap Speed Loader", *The American Rifleman;* Nov. 1976, p. 42.

*Primary Examiner*—Charles T. Jordan

[57] ABSTRACT

The invention is a charge container to contain all of the components necessary to load a muzzle-loading rifle and to protect the components from contamination and wetness. The container comprises a plastic body having a chamber for the main propellant charge and for a projectile. A closure lid is provided and the percussion cap is held in a socket on the underside of the lid. The cap holding socket is enclosed within the body when the lid is closed protecting the percussion cap from wetness.

6 Claims, 18 Drawing Figures

WATER RESISTANT CHARGE CONTAINER FOR FIREARMS

FIELD OF THE INVENTION

The device is intended for use with muzzle-loading rifles for hunting and target shooting.

DESCRIPTION OF THE PRIOR ART

A number of charge containing devices have appeared in the past, some of which have included provision for holding a percussion cap in readiness but the cap holding part has always been either on the outside where it is exposed to rain or has been placed in an awkward position on the container so as to make it difficult to quickly place the percussion cap upon the nipple of the rifle. This novel invention places the percussion cap on the underside of the container lid which encloses the cap and protects it while at the same time making it very easy and simple to place the percussion cap upon the nipple due to the thin construction of the lid which is easily insertable between the nipple and the hammer of the rifle lock. The placement of the cap holder on the underside of the lid and the enclosing of the cap within the body of the container is a novel departure from the prior art and represents a new and useful improvement invention.

SUMMARY OF THE INVENTION

It is an object of this invention to provide a new and novel charge container that places all of the necessary loading components at the disposal of the hunter for instant use while at the same time providing protection for all components against wetness and contamination.

It is a further object of this invention to provide a more compact and simple container that is safer to use as the lid is less prone to accidental dislodgement while carried in the field.

A BRIEF DESCRIPTION OF THE DRAWINGS

DESCRIPTION OF THE PREFERRED EMBODIMENT

Figure 1:
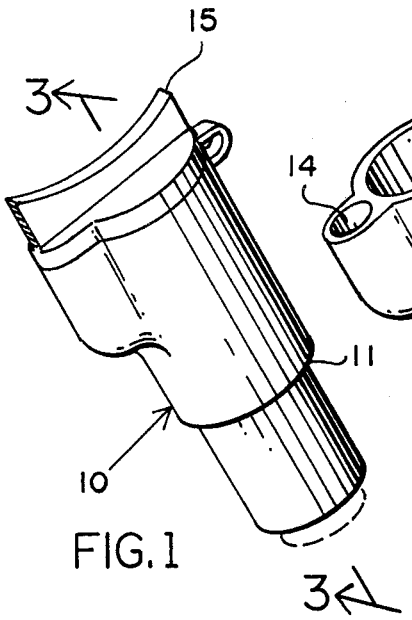
FIG. 1 is a perspective view of the container.

Referring to the drawings by characters of reference, FIGS. 1–18 illustrate a water resistant charge container for firearms.

The container 10 is constructed of a plastic material. The upper part of the container body 11 is for containing a charge of gunpowder. The lower part of the body 11 is for containing a projectile, the projectile being held by the inner surface 13, the projectile also acting as a closure for the lower section of the container. The presence of the projectile in lower part 13 creates the upper chamber 12 for containing the powder charge. The chamber 12 is closed by the lid 15. The sealing section 16 of the lid 15 fits tightly within the chamber 12 for sealing and for retaining the lid in place on the container body 11. A cap holding cavity 17 is mounted on the underside of the lid 15 and the separate cavity 14 is provided on the body 11 to receive the cap holder together with a percussuion cap when the lid 15 is in a closed position, and to seal the percussion cap against water and contamination. The cap holder cavity is provided with the split 18 to allow the cavity walls to deflect for releasing the percussion cap when the percussion cap is placed upon the breech nipple of a rifle. The separate chamber 14 keeps the percussion cap separated from the powder charge contained in chamber 12.

Figure 2:
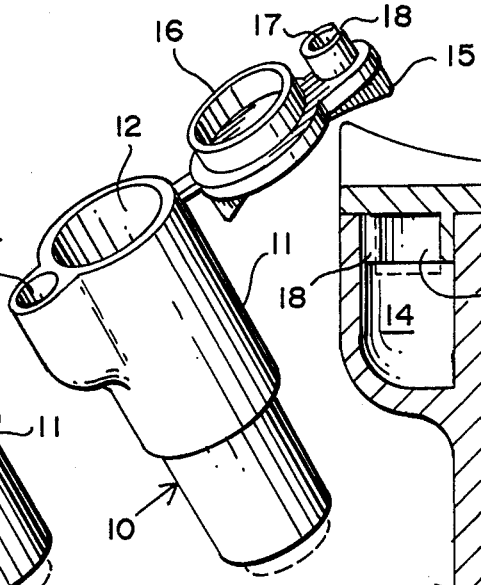
FIG. 2 shows the container with the lid open.
Figure 3:
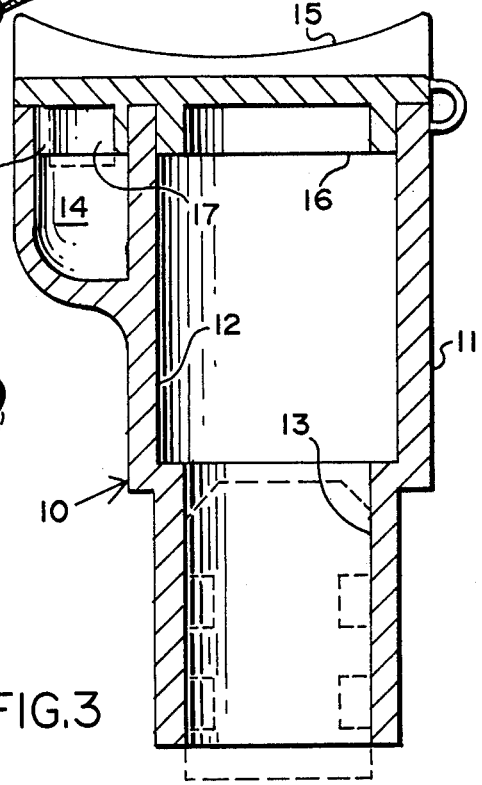
FIG. 3 is a cross sectional view of the container.
Figure 4:
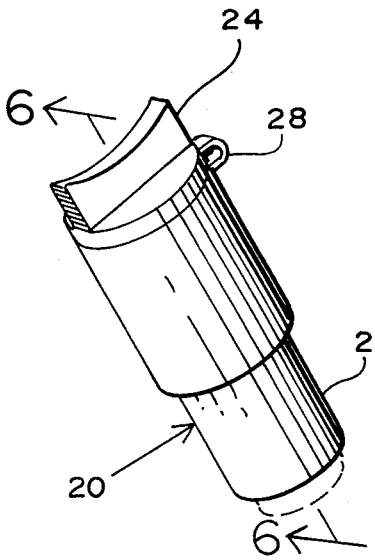
FIG. 4 is a perspective view of an alternate variation of the container.
Figure 5:
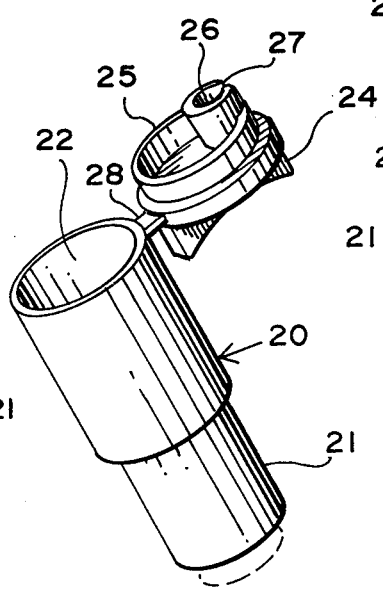
FIG. 5 shows the alternate variation container with the lid open and shows the location of the cap holder.
Figure 6:
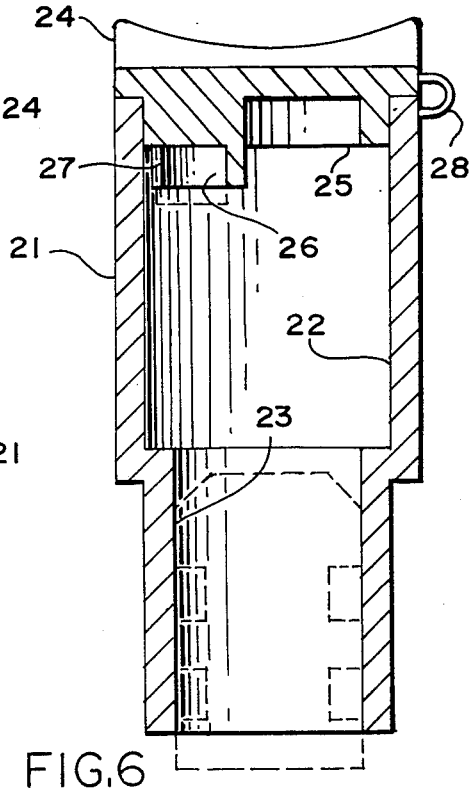
FIG. 6 is a cross sectional view of the alternate variation container.

FIGS. 4–6 show a variation of the device shown in FIGS. 1–3 and shows that the cap holder 26 can be mounted on the underside of the lid 24 and thereby contain the percussion cap within the confines of the chamber 22 along with a powder charge. Although the drawings show the cap holder 26 facing downward into the charge containing chamber 22, the cap holder 26 may be mounted with the open end facing toward the wall of the chamber 22 so as to avoid pressure against the explosive pellet in the percussion cap when the lid 24 is closed. In this first variation, the chamber 22 is sealed when the sealing section 25 is pressed into the body 21 and the projectile is held by the inner surface 23 of the container 20. The cap holder 26 is provided with the split 27 for deflection of the cap holder wall. The hinge 28 is provided to avoid loss of the lid 24 when the lid 24 is opened.

Figure 7:
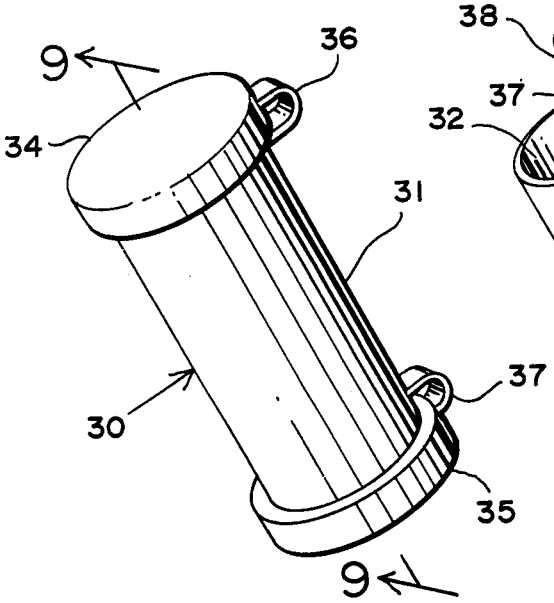
FIG. 7 is a perspective view of an additional variation.
Figure 8:
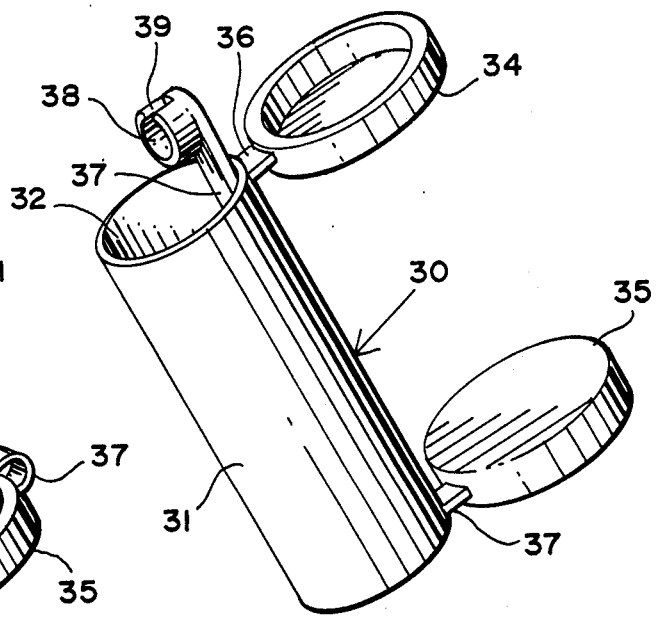
FIG. 8 shows the additional variation with the lid open and the cap holder protruding.
Figure 9:
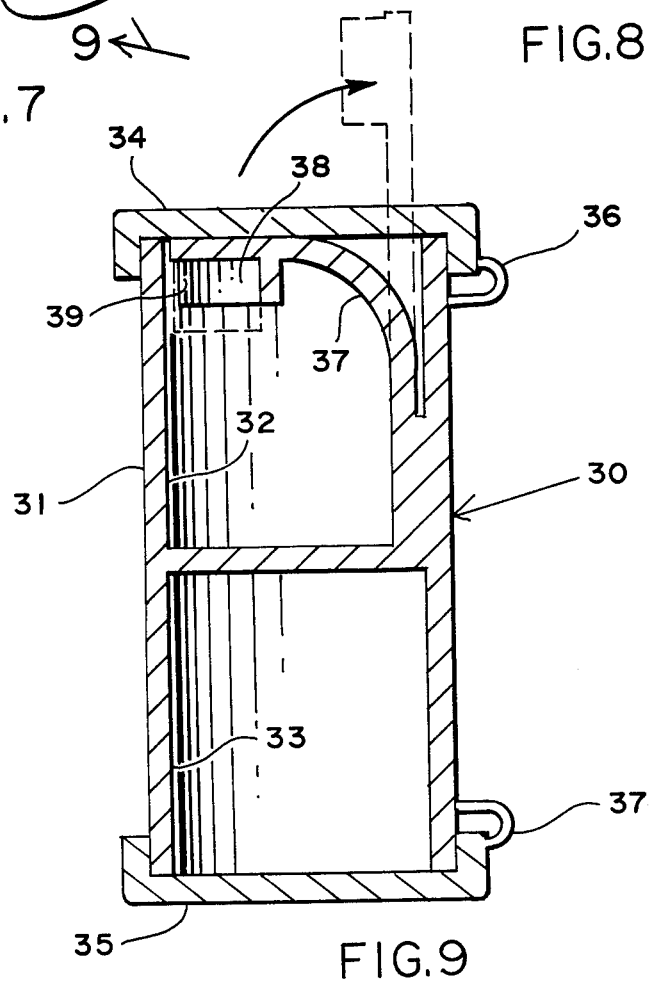
FIG. 9 shows the container variation with the lis closed, the view being a cross sectional view.

FIGS. 7–9 illustrate a second variation of a container 30. The body 31 has two component containing chambers 32 and 33 and two lids 34 and 35. Although a device of this type is well known, those with cap holding means have mounted the capholder on the outside of the container where the cap is exposed to rain and other forms of contamination. This variation also places the cap holder within the body of the container where the percussion cap is protected. The cap holder 38 is mounted on the neck 37 which is formed on the inside wall of the chamber 32. The cap holder neck 37 is flexible and bends down into the chamber 32 when the lid 34 is moved to a closed position. When the lid 34 is opened, the neck 37 will flex upward so that the cap holder 38 and the percussion cap protrude from the body 31 of the container for rapid transferral of the percussion cap to the breech nipple of a rifle. A split 39 is provided in the wall of the cap holder 38 for deflection of the capholder wall. The hinge 36 is included to avoid loss of the lid 34 when the lid 34 is opened. Other load components can be contained within the chambers 32 or 33 such as a projectile, patch or powder charge. The hinge 37 is provided as for hinge 36. Although the drawings show that the open end of the capholder faces downward into the interior of the component containing chamber it is obvious that it can be made to face upward when the lid is closed.

Figure 10:
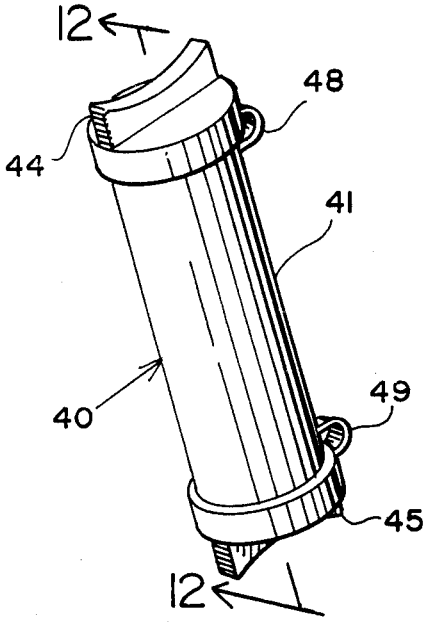
FIG. 10 shows an additional variation with the lid in the closed position.
Figure 11:
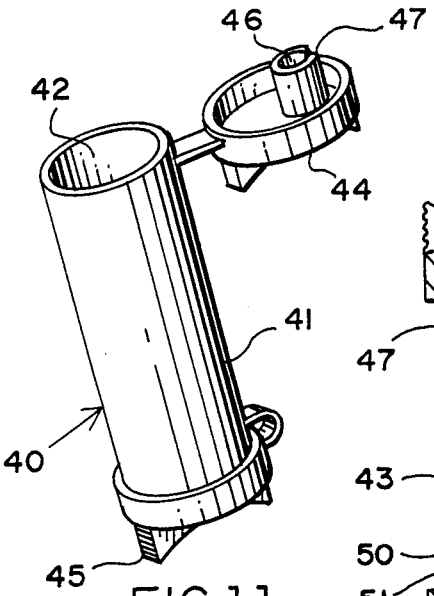
FIG. 11 shows a third variation with the lid open and the cap holder visible on the underside of the lid.
Figure 12:
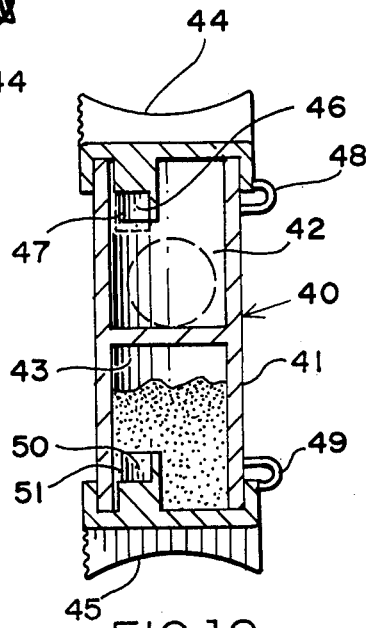
FIG. 12 is a cross sectional view of the third variation of the container.

FIGS. 10–12 illustrate a third variation container 40. The body 41 has two component chambers 42 and 43 and two lids 44 and 45. Two cap holders 46 and 50 are mounted on the underside of the two lids 44 and 45. Although the drawing shows cap holders on both lids it is obvious that the capholder 50 in chamber 43 could be omitted. The lids 44 and 45 fit tightly over the ends of body 41 for sealing against contamination. FIG. 12 shows in broken lines a ball projectile contained in chamber 42 where it is available for instant use when the lid 44 is opened. Percussion caps are to be held by cap holders 46 and 50 for transfer to a breech nipple when lids 44 or 45 are opened. Hinges 48 and 49 are provided so the lids 44 and 45 are retained when in an open position. The splits 47 and 51 are provided for deflection of the cap holder wall.

Figure 13:
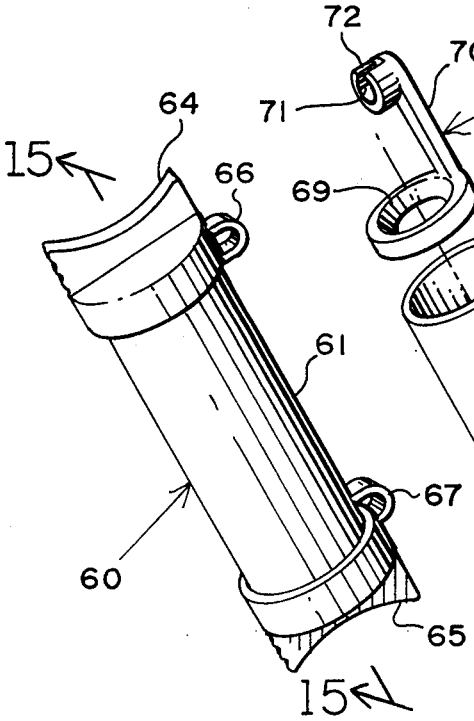
FIG. 13 shows a fourth variation with the lid in a closed position.
Figure 14:
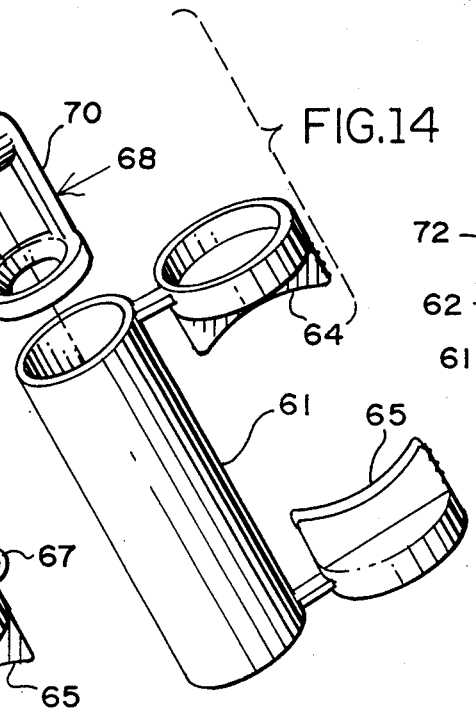
FIG. 14 shows the fourth variation with the lid open and the cap holder removed from the container.
Figure 15:
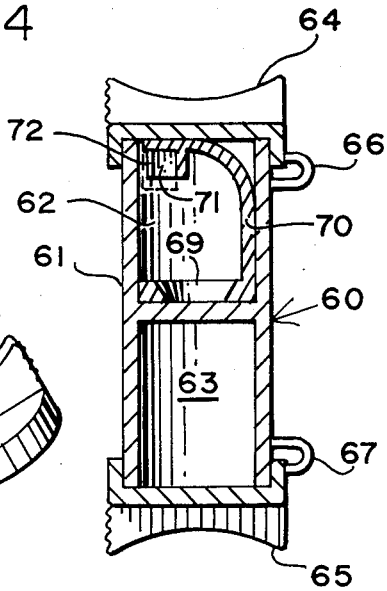
FIG. 15 shows the fourth variation container in cross section.

FIGS. 13–15 illustate a charge container 60. The body 61 has two component containing chambers 62 and 63. This is a fourth variation and features a separate cap holder 68 which is insertable into either of the component containing chambers 62 and 63. The cap holder 68 has a base 69 and a neck 70. The neck 70 is flexible and is intended to protrude from the chamber 62 when lid 64 is opened to place the cap holding socket 71 together with a percussion cap held in the socket 71 ready for transfer to the breech nipple of a firearm. The neck 70 together with the cap holding socket 71 is folded down and enclosed in the chamber 62 when the lid 64 is moved to a closed position. The cap holding socket 71 is provided with the wall split 72 to allow the socket 71 to deflect from around a percussion cap when the percussion cap is placed upon the breech nipple of a firearm.

Figure 17:
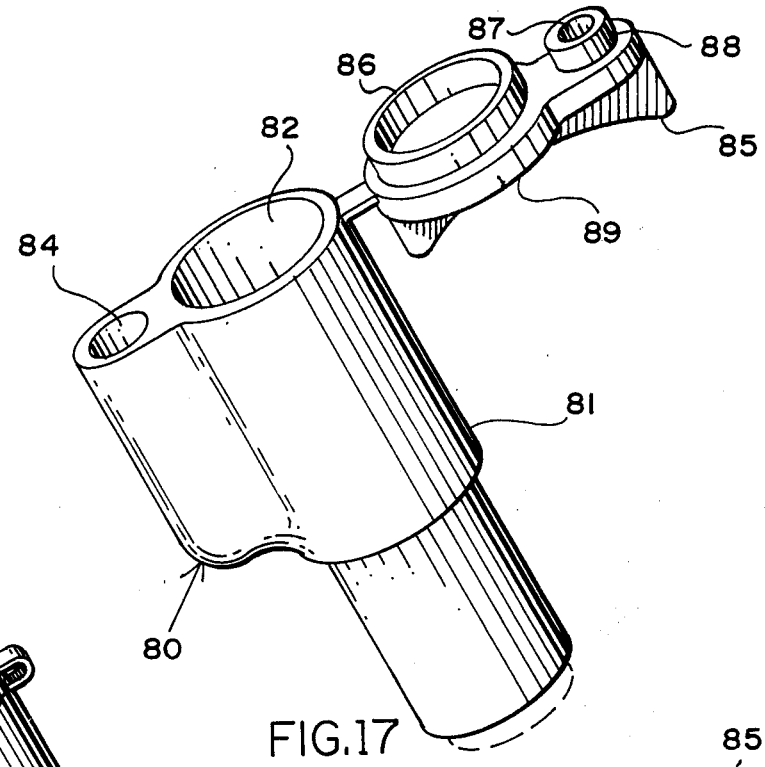
FIG. 17 shows the fifth variation with the lid open.
Figure 16:
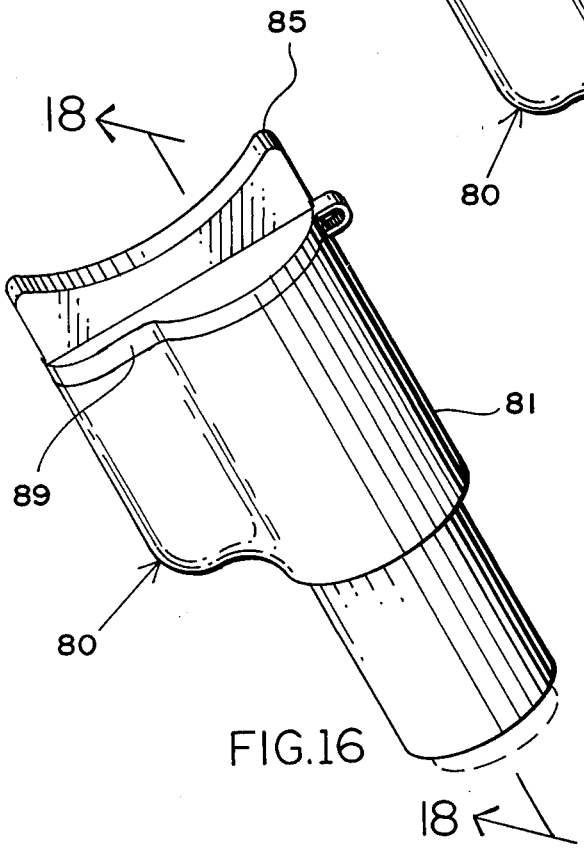
FIG. 16 shows a fifth variation with the lid closed.
Figure 18:
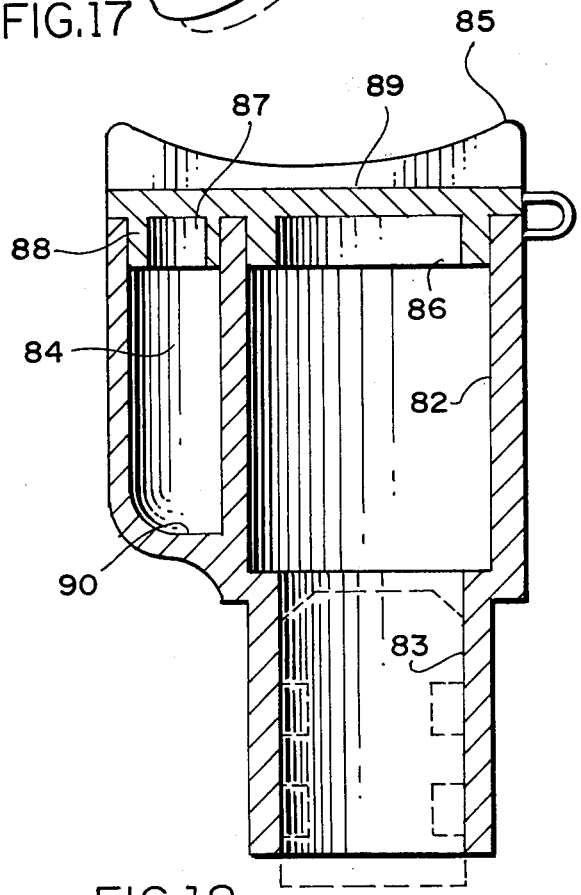
FIG. 18 shows the fifth variation container in cross section.

FIGS. 16–18 illustrate a fifth variation of a charge container which is intended for use with muzzle loading rifles using the flintlock type of ignition. The container 80 has a body 82 which is provided with the lid 89. The body 81 has an upper chamber 82 for containing a power charge and a lower chamber 83 for containing a projectile. The projectile shown in broken lines also acts as a closure to contain the powder charge in chamber 82. A second chamber 84 is provided to contain a priming powder charge for transferral to the flashpan of a flintlock rifle. The lid 89 has the sealing lip 86 and sealing lip 88 formed on its underside. The sealing lip 86 fits into the cavity 82 and the sealing lip 88 fits into cavity 84 when the lid 89 is moved to a closed position, sealing both cavities against moisture and contamination. The lid 89 is provided with the eared portion 85 to provide purchase for the thumb of the user for pushing the lid 89 to an opened position. In use, the user must hold the end of one of his fingers over the open end of cavity 84 while transfering the main powder charge from cavity 82 to the barrel of a firearm to avoid spillage of the priming charge from cavity 84. The socket 87 formed by the sealing lip 88 may be adaptable to hold a percussion cap if desired so that the container may be used for either a percussion rifle charge or for a flintlock rifle charge. The chambers 82 and 83 are open at both ends before charging but the chamber 84 is formed to be closed at the lower end 90.

OPERATION OF THE DEVICE

To use the container illustrated in FIGS. 1–3, a projectile is inserted into the lower section 13. The projectile acts as a closure section. With the lid 15 in an open position, a premeasured charge of gunpowder is placed into the upper chamber 12 and a percussion cap is placed into the cap holder 17. The lid 15 is then moved to a closed position, the sealing lip 16 fitting tightly in the opening of the chamber 12 and the sealing lip 17 fitting tightly in the cavity 14 to seal against moisture and other contamination and to contain the powder charge. When loading a rifle, the lid 15 is pushed open with the user's thumb. The powder charge contained in the chamber 12 is poured into the muzzle of the rifle barrel. The lower section 13 of the container is then placed against the muzzle of the rifle barrel and the projectile is pushed from the confines of 13 and into the barrel of a rifle with a ramrod. The projectile is pushed into the rifle barrel to where it comes to rest against the powder charge. The opened lid now carries the percussion cap. The lid 15 is now held over the breech nipple of the rifle with the percussion cap aligned with the nipple. The lid 15 is pushed downward toward the nipple so that the percussion cap is placed firmly upon the nipple. The lid 15 is then withdrawn at a 90 degree angle, the slit 18 allowing the cap holder 17 to deflect around the percussion cap and leaving the percussion cap firmly placed on the nipple.

To use the container shown in FIGS. 4–6, the procedure is the same as set forth above except that the cap holder 26 is enclosed within the chamber 22 together with the powder charge.

To use the container shown in FIGS. 7–9, the lid 34 in an open position, a projectile is placed in the chamber 32 and a percussion cap is placed in the socket 38. The lid 34 is then moved to a closed position which bends flexible neck 37 and carries socket 38 and a percussion cap into the confines of the chamber 32 where it is held by the lid 34. The lid 35 is then opened and a charge of gunpowder is placed in the chamber 33 and the lid 35 is closed. To load a rifle, the lid 34 is pushed open with the user's thumb. The projectile is removed from the chamber 32. The lid 35 is opened in the same manner and the power charge is poured into the barrel of a rifle, followed by the projectile. The cap holder 38 is now protruding on the neck 37. The cap holder 38 is now pushed down over the breech nipple of a rifle seating the percussion cap upon the nipple. The slit 39 on cap holder 38 allows the walls of 38 to deflect as the capholder 38 is pulled away at right angle leaving the percussion cap firmly seated on the nipple.

To use the container illustrated in FIGS. 10–12 the procedure is the same as the foregoing for FIGS. 7–9 except for placing the percussion cap upon the nipple which is the same as for FIGS. 1–3.

To use the container shown in FIGS. 13–15, the procedure is the same as for FIGS. 7–9. The difference in the containers being that the cap holder 68 is a separate moulding and is inserted into the chamber 62.

The container shown in FIGS. 16–18 is intended for flintlock rifles and carries a priming charge of gunpowder instead of a percussion cap. With the lid 85 open, powder charges can be placed into both chambers. First a projectile is placed into the lower chamber 83. A pre-measured powder charge is then placed into the upper chamber 82. A priming charge of powder is then placed in the smaller chamber 84. The lid 85 is then closed so to seal the powder charges against moisture and contamination. To load a rifle, the lid 85 is pushed upon with the user's thumb. One of the user's fingers is then held over the open end of the chamber 84 while the powder charge in chamber 82 is poured into the barrel of the rifle. The lower section 83 containing the projectile is then placed against the muzzle of the rifle and the projectile is pushed from the container into the barrel where it is seated. The user then opens the flashpan of the rifle, removes his finger from the opening of chamber 84 and pours the priming charge into the pan.

The container illustrated in FIGS. 16–18 has an additional novelty in that when used with a flintlock rifle, if the lid hinge is removed or omitted, the user may lift the lid open in such a manner as to lift the sealing lip 86 from the chamber 82but leaving the sealing lip 87 within the chamber 84. The lid 85 is then pivoted around the axis of sealing lip 87 allowing the powder charge contained in chamber 82 to be transferred to the barrel of a firearm while the priming charge contained in chamber 84 remains sealed. When the user desires to transfer the priming charge, the entire lid 85 is removed exposing the priming charge in chamber 84 which is then ready for transfer. This method avoids spillage of the priming charge while the main charge is being transferred and also precludes contamination of the priming charge at that time.

Although but a few embodiments of the invention have been shown and described, it will be apparent to those skilled in the art that various changes and modifications may be made therein without departing from the spirit of the invention or from the scope of the appended claims.

I claim:

1. In a charge container for use with muzzle loading firearms, said container having a body, said body having a first chamber for containing at least one charge component, a second chamber for containing an additional component, partition means separating said first chamber and said second chamber, closure means for confining said components within said first chamber and said second chamber, the combination with said body, said first chamber, said second chamber, said partition means and said closure means of percussion cap holding means, said percussion cap holding means being mounted on the underside of said closure means, said percussion cap holding means and a percussion cap held thereby being completely enclosed within the outermost confines of said body and said closure means when said closure means is in a closed position for protecting said percussion cap against contamination.

2. In a charge container for use with muzzle loading firearms, said container having a body, said body having chamber means for containing one or more charge components, closure means for mounting on said body to confine said components within said body, the combination with said body, said chamber means and said closure means of cap holding means for holding a percussion cap, said cap holding means being mounted within said chamber means and being extendable therefrom for rapid transferral of a percussion cap to a breech nipple of a firearm.

3. In a charge container for use with muzzle loading firearms, said container having a body, said body having a chamber for containing one or more charge components, closure means for mounting on said body to confine said components within said body, the combination with said body, said chamber and said closure means of an additional chamber for containing a priming powder charge and sealing means mounted on said closure means, said closure means being of one piece construction, said closure means extending across one end of said body and closing both of said chambers.

4. The structure as recited by claim 3 wherein said sealing means is adaptable to hold a percussion cap.

5. The structure as recited by claim 3 wherein said sealing means provide a separate seal for each of said chambers, said closure means being pivotable on said body when either of said seals is disengaged from said body.

6. In a charge container for use with muzzle loading firearms, said container having a body, said body being of tubular configuration, an open bore extending through the entire length of said body, said bore having a first open end and a second open end, closure means for selectively closing said first open end, said second open end being closable by a projectile inserted therein, the combination with said body, said open bore, said first open end, said second open end and said closure means of percussion cap holding means, said percussion cap holding means being mounted on the underside of said closure means, said percussion cap holding means and a percussion cap held thereby being completely enclosed within the outermost confines of said body and said closure means when said closure means is in a closed position for protection of a percussion cap against contamination.

* * * * *